US009398798B2

(12) United States Patent
Yi et al.

(10) Patent No.: US 9,398,798 B2
(45) Date of Patent: Jul. 26, 2016

(54) NAIL ART DEVICE, SYSTEM, AND METHOD USING UV LIGHT

(71) Applicants: Sung Won Yi, Yongin-si (KR); Chang Man Park, Yongin-si (KR); Jun Oh Kim, Yongin-si (KR); Chan Ki Lee, Yongin-si (KR); Young Jin Lee, Yongin-si (KR); Jin Gug Kim, Yongin-si (KR)

(72) Inventors: Sung Won Yi, Yongin-si (KR); Chang Man Park, Yongin-si (KR); Jun Oh Kim, Yongin-si (KR); Chan Ki Lee, Yongin-si (KR); Young Jin Lee, Yongin-si (KR); Jin Gug Kim, Yongin-si (KR)

(73) Assignee: AMOREPACIFIC CORPORATION (KR)

( * ) Notice: Subject to any disclaimer, the term of this patent is extended or adjusted under 35 U.S.C. 154(b) by 0 days.

(21) Appl. No.: 14/404,185

(22) PCT Filed: Apr. 23, 2013

(86) PCT No.: PCT/KR2013/003440
§ 371 (c)(1),
(2) Date: Nov. 26, 2014

(87) PCT Pub. No.: WO2013/180390
PCT Pub. Date: Dec. 5, 2013

(65) Prior Publication Data

US 2015/0182001 A1 Jul. 2, 2015

(30) Foreign Application Priority Data

May 31, 2012 (KR) ..... 10-2012-0058158
Apr. 19, 2013 (KR) ..... 10-2013-0043547

(51) Int. Cl.
*A45D 29/00* (2006.01)

(52) U.S. Cl.
CPC ..... *A45D 29/00* (2013.01); *A45D 2029/005* (2013.01)

(58) Field of Classification Search
CPC ..... A45D 29/00; A45D 2029/005; A45D 29/004; A45D 31/00; A61N 5/0624; A61N 5/06; B41J 2/01
See application file for complete search history.

(56) References Cited

U.S. PATENT DOCUMENTS

2007/0208395 A1* 9/2007 Leclerc ..... A61N 5/0616 607/86
2012/0147107 A1* 6/2012 Bitoh ..... A45D 29/00 347/101
2014/0194955 A1* 7/2014 Povolosky ..... A61N 2/002 607/89

FOREIGN PATENT DOCUMENTS

CN 201102358 Y * 8/2008
JP 2002165632 A * 6/2002

(Continued)

OTHER PUBLICATIONS

International Search Report—PCT/KR2013/003440 dated Aug. 23, 2014.

(Continued)

*Primary Examiner* — Robyn Doan
(74) *Attorney, Agent, or Firm* — Cantor Colburn LLP

(57) ABSTRACT

The nail art device having a control unit; a holder; a display panel that displays a predetermined selected pattern through the control of the control unit; and a UV irradiation unit that irradiates the display panel with UV rays is provided. When a finger, to the nail of which polish having a UV-reactive component has been applied, is placed in the holder, the polish applied to the nail reacts with the UV rays which are transmitted through the display panel where the selected pattern is displayed to form a nail pattern.

4 Claims, 4 Drawing Sheets

(56) References Cited

FOREIGN PATENT DOCUMENTS

| | | | | |
|---|---|---|---|---|
| JP | 2003009938 | A | * | 1/2003 |
| JP | 2007062062 | A | * | 3/2007 |
| KR | 1020000006356 | | | 1/2000 |
| KR | 1020030014922 | | | 2/2003 |
| KR | 1020050098085 | | | 10/2005 |
| KR | 1020110009430 | | | 1/2011 |
| KR | 101030390 | | | 4/2011 |
| KR | WO 2014104418 | A1 | * | 7/2014 ..... A45D 29/00 |

OTHER PUBLICATIONS

Written Opinion—PCT/KR2013/003440 dated Aug. 23, 2013.

* cited by examiner

NAIL ART DEVICE, SYSTEM, AND METHOD USING UV LIGHT

TECHNICAL FIELD

Exemplary embodiments relate to a device, a system, and a method for nail art, and more particularly, to a device, a system, and a method for nail art using UV light (ultraviolet).

BACKGROUND ART

Unlike typical print media such as paper, since a nail is a portion of a human body, the nail has physical properties that are relatively small in size, have a non-flat surface, and are not easy to print.

Accordingly, it is difficult to engrave an elaborate and beautiful pattern desired by a user on the nail by means of nail art work through a printing process.

In addition, due to the nature of the printing process using ink, it is difficult to apply a manicure used for manual nail art to the printing process. Therefore, such a printing process has a limit to reproduction of characteristics, such as texture, color, and expression, of the nail art using the manicure.

Meanwhile, there is a Korean Patent No. 10-1030390 as a related art.

SUMMARY OF INVENTION

Technical Problem

Various embodiments are directed to providing a device, a system, and a method for nail art, capable of engraving an elaborate and beautiful pattern on a nail by improving a limit of a printing manner.

In addition, various embodiments are directed to providing a device, a system, and a method for nail art, capable of maximally realizing characteristics, such as texture, color, and expression, of nail art using a manicure.

Technical solution to achieve the present invention is not limited to the technical solution mentioned above; other technical solutions not mentioned here are to be clearly understood to those skilled in the art by following descriptions.

Technical Solution

In accordance with an aspect of the present disclosure, a nail art device includes a control unit, a holder, a display panel to display a predetermined selected pattern under control of the control unit, and a UV irradiation unit to irradiate UV light onto the display panel. Here, a manicure containing UV responsive elements on a nail, which is put on the holder, reacts to UV light transferred by transmitting the display panel to thus form a nail pattern.

The nail art device may further include a communication unit which communicates with an external user device, and the control unit may receive pattern information according to a user's selection through the communication unit from the user device, and then output a control signal corresponding to the received pattern information, thereby allowing the selected pattern to be displayed on the display panel.

In the nail art device, the holder may be concavely formed at a position facing the display panel such that a finger, the nail of which is applied with the manicure containing UV responsive elements, is put on the holder.

In the nail art device, the nail pattern may be formed by giving a shade difference to the manicure containing UV responsive elements applied to the nail using the difference of UV transmittance due to the selected pattern formed on the display panel.

In the nail art device, the display panel may be a liquid crystal display panel.

In accordance with another aspect of the present disclosure, a nail art system includes a nail art device including a control unit, a holder, a display panel to display a predetermined selected pattern under control of the control unit, and a UV irradiation unit to irradiate UV light onto the display panel, and a user device which provides an inquiry function and a selection function such that a user is able to select any one of a plurality of patterns, and is connected to the nail art device to transmit pattern information according to a user's selection. Here, the nail art device receives pattern information from the user device to display a selected pattern corresponding to the received pattern information on the display panel, thereby allowing a manicure containing UV responsive elements on a nail which is put on the holder to react to UV light transferred by transmitting the display panel, to thus form a nail pattern.

In the nail art system, the user device may be at least any one of a smart phone, a smart television, and a Personal computer which are loaded with at least one application providing a user interface for inquiry, selection, and transmission functions of the plural patterns.

In the nail art system, the user device may allow a pattern inquired or selected by a user to be displayed together on the display panel by synchronizing at least a portion of a screen of the user device with a screen of the display panel provided in the nail art device.

In accordance with a further aspect of the present disclosure, a nail art method using a device including a display panel and a holder, includes the device setting a communication link to be connected to an external user device, the device receiving pattern information according to a user's selection from the user device, and the device displaying a selected pattern on the display panel corresponding to the received pattern information and irradiating UV light onto the display panel, thereby allowing, when a finger, a nail of which is applied with a manicure containing UV responsive elements, is put on the holder, the manicure containing UV responsive elements to react to UV light transferred by transmitting the display panel, to thus form a nail pattern.

Advantageous Effects

In accordance with the embodiments, it may be possible to engrave an elaborate and beautiful pattern on a nail by improving a limit of a printing manner using UV light.

In addition, in accordance with the embodiments, it may be possible to maximally realize characteristics, such as texture, color, and expression, of nail art using a manicure.

Furthermore, in accordance with the embodiments, anyone may easily select a desired nail pattern to automatically perform nail art work, and it may be possible to reduce costs and time required for nail art.

Accordingly, in accordance with the embodiments, it may be possible to engrave an elaborate and beautiful pattern on a nail by improving a limit of a printing manner, and anyone can easily automatically perform nail art work so that it may be possible to reduce costs and time required for nail art.

| <Explanation of symbols> | |
|---|---|
| 110: holder | 120: display panel |
| 130: UV irradiation unit | 140: control unit |
| 150: communication unit | 160: battery |
| 170: charging unit | |

Best Mode

Hereinafter, exemplary embodiments will be described in further detail with reference to the accompanying drawings.

Figure 1:
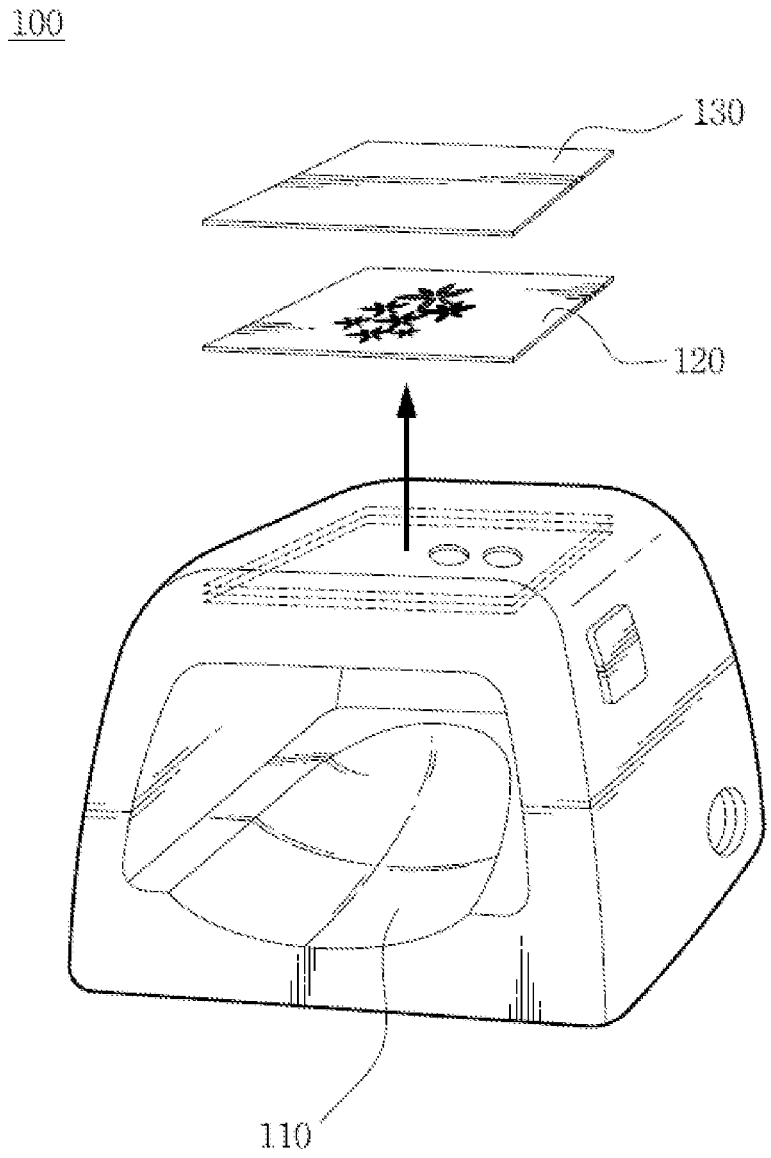
FIG. 1 is a view illustrating a configuration of a nail art device according to an embodiment.
Figure 2:
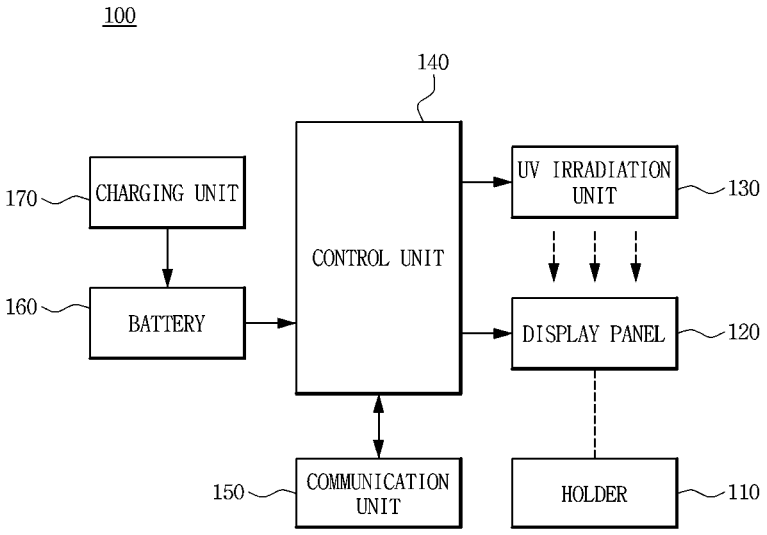
FIG. 2 is a functional block diagram of the nail art device according to the embodiment.

FIG. 1 is a view illustrating a configuration of a nail art (also referred as "nail polish") device according to an embodiment. FIG. 2 is a functional block diagram of the nail art device according to the embodiment.

As shown in FIG. 1, a nail art device 100 according to an embodiment includes a holder 110 on which a user's finger is put for nail art work, a display panel 120 to display patterns for nail art work on a screen, a UV (ultraviolet) irradiation unit 130 to irradiate UV light onto the display panel 120, etc.

In addition, the nail art device 100 may include, as shown in FIG. 2, a control unit 140 to control each part thereof, a communication unit 150 which transmits and receives data to and from the outside, a battery 160 to supply power, and a charging unit 170.

In the embodiment, the holder 110 is concavely formed at a position facing the display panel 120 such that a finger, a nail of which is applied with a manicure containing UV responsive elements, is put on the holder 110, as shown in FIG. 1.

The display panel 120 is mounted to face the holder 110 which is formed of a size corresponding to a person's nail, and operates to display a specific selection pattern under control of the control unit 140.

In the embodiment, a user may install an application for nail art work in user's own user device (for example, a smart phone, a smart television, or the like), and may select a desired pattern through the application to transmit the same to the nail art device 100.

The control unit 140 receives pattern information according to a user's selection through the communication unit 150 from the user device, and then outputs a control signal (for example, a data voltage or a drive pulse based on pixel data of the pattern) corresponding to the received pattern information, thereby allowing a selected pattern to be displayed on the display panel 120.

After viewing various nail patterns using the application of the carrying user device, a user may select a desired specific pattern to transmit information of the pattern to the nail art device 100.

The communication unit 150 serves to transmit and receive the pattern selected by a user in such a way to communicate with an external user device by setup of a communication link. For example, such a communication unit 150 may include a communication device such as a USB (Universal Serial Bus) terminal or an earphone terminal, and a short range wireless communication module such as Wi-Fi, Bluetooth, or NFC (Near Field Communication).

After selecting a desired nail pattern through the application of the user device, a user puts the finger, the nail of which is applied with the manicure containing UV responsive elements, on the holder 110 and causes user's own nail applied with the manicure to be located at a position facing the display panel 120, in order to perform the nail art work.

As described above, the control unit 140 receives pattern information according to a user's selection by communicating with the user device through the communication unit 150, and then generates a control signal corresponding to the pattern information to output the same to the display panel 120, thereby allowing the pattern selected by a user to be displayed on the display panel 120.

Moreover, the control unit 140 causes the UV irradiation unit 130 to be driven so that UV light is irradiated onto the display panel 120.

In the embodiment, the UV irradiation unit 130 may be arranged in the form of a UV LED (Ultraviolet Light Emitting Diode), and be located above the display panel 120.

In this case, the display panel 120 transmitting UV light is closely located to the manicure containing UV responsive elements applied to the nail of a user such that they face each other.

UV light emitted from the UV irradiation unit 130 transmits the display panel 120, which is displaying the selected pattern, to reach the nail put on the holder 110. Thus, the manicure containing UV responsive elements on the nail put on the holder 110 reacts to UV light transmitting the display panel 120, thereby enabling a nail pattern to be formed.

In the embodiment, the manicure containing UV responsive elements on the nail may be a gel manicure cured by UV light. In this case, it may be possible to form the nail pattern on the nail using properties of the gel manicure cured by UV light.

UV light, which is emitted from the UV irradiation unit 130 located above the display panel 120, is blocked or transmitted depending on the selected pattern on the display panel 120. UV transmittance differs between a portion in which the selected pattern is formed and a portion in which the selected pattern is not formed, on the screen of the display panel 120. Therefore, due to the difference of the UV transmittance, a difference in the curing rate of the gel manicure and a resultant shade difference of the manicure are generated, with the consequence that the nail pattern may be formed on the nail using the same.

That is, the nail pattern is formed by giving the shade difference to the manicure containing UV responsive elements applied to the nail using the difference of the UV transmittance due to the selected pattern formed on the display panel 120.

In the embodiment, when the display panel 120 is realized as a liquid crystal display panel, it may be possible to effectively reflect the difference of the UV transmittance according to the selected pattern which is being displayed.

A variety of UV responsive element substances contained in general UV curing agents may be used as the UV responsive elements contained in the manicure.

Examples of the UV responsive element substances may include epoxy acrylate based, polyester acrylate based, urethane acrylate based, polybutadiene acrylate based, silicon acrylate based, alkyl acrylate based materials, etc.

For example, in a case where resin photopolymerized by UV light is used, when UV light is irradiated, a photopolymerization reaction begins by the UV light. Consequently, a monomer and an oligomer, which are main components of the resin, instantaneously form a polymer and are cured. Although the monomer and the oligomer which are main components of the resin are liquid due to low molecular weight thereof, the cured polymer is solid state (that is, a hard state) due to high molecular weight thereof.

The UV responsive element substances usable in the manicure in the present embodiment are not limited to the above-mentioned examples. For example, if cured by UV light, any substance may be used regardless of sorts. Furthermore, it may also be possible to use any substance curable by reactions other than the photopolymerization reaction by UV light.

Figure 3:
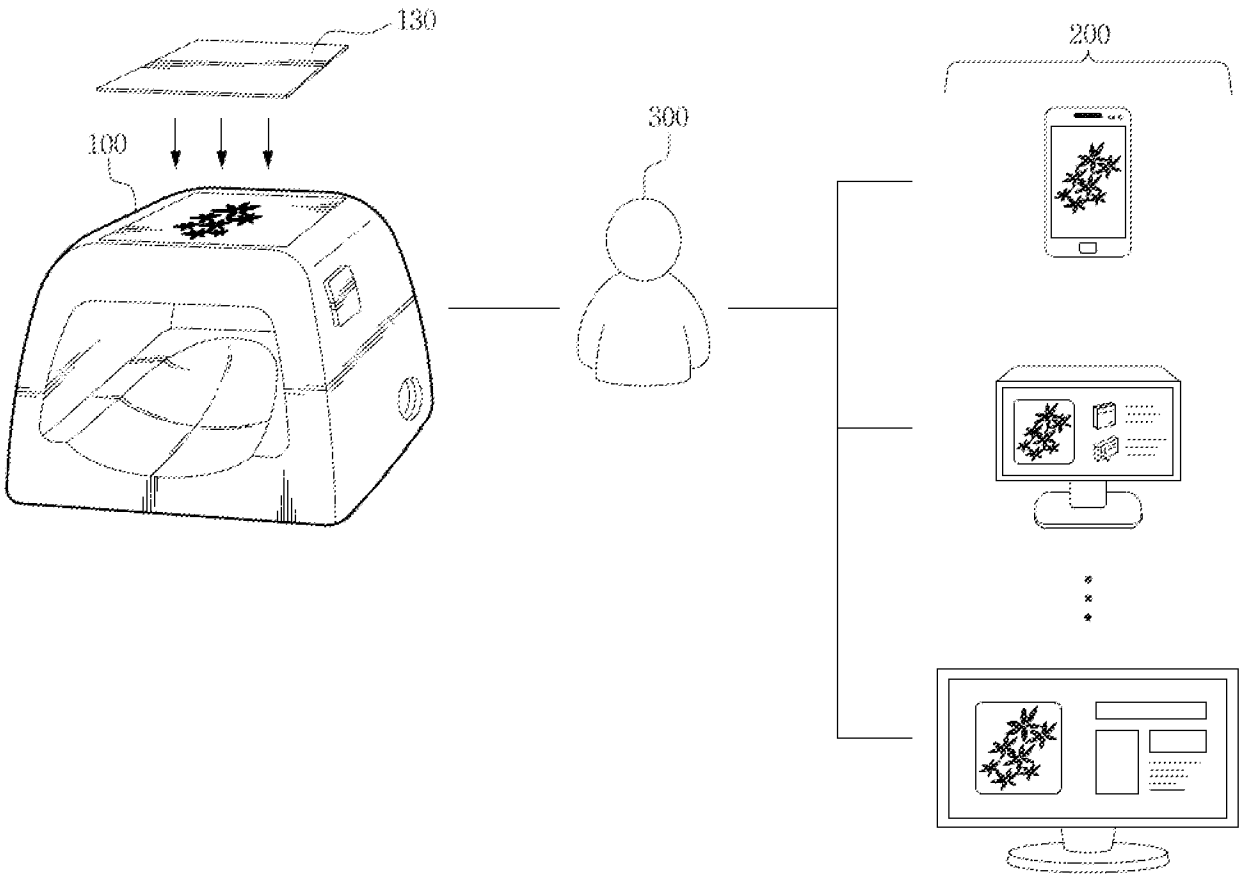
FIG. 3 is a view illustrating a configuration of a nail art system according to another embodiment.

FIG. 3 is a view illustrating a configuration of a nail art system according to another embodiment.

A user 300 may connect to a nail art device 100 using user's own user device 200 to select a desired pattern for nail art. The nail art device 100 includes, as described above, the control unit 140, the holder 110, the display panel 120 to display a predetermined selected pattern under control of the control unit 140, and the UV irradiation unit 130 to irradiate UV light onto the display panel 120.

An application installed in the user device 200 provides an inquiry function and a selection function such that the user 300 may select any one of a plurality of patterns for nail art, and is connected to the nail art device 100 to transmit pattern information according to a user's selection.

When the user 300 inquiries into the patterns for nail art using the application of the user device 200 and then selects one pattern of them, information of the pattern is transmitted to the nail art device 100, so that the selected pattern corresponding to the pattern information received from the user device 200 is displayed on the display panel 120 of the nail art device 100.

In the embodiment, the user device 200 is loaded with an application which provides a user interface for inquiry, selection, and transmission functions of the plural patterns. As such a user device 200, a smart phone, a smart television, a PC (Personal Computer), and the like may be utilized.

Furthermore, the user device 200 may enhance a user's convenience in such a way as to allow the pattern inquired or selected by the user 300 on the user device 200 to be displayed together on the display panel 120 by synchronizing at least a portion of a screen of the user device 200 with a screen of the display panel 120 provided in the nail art device 100.

Figure 4:
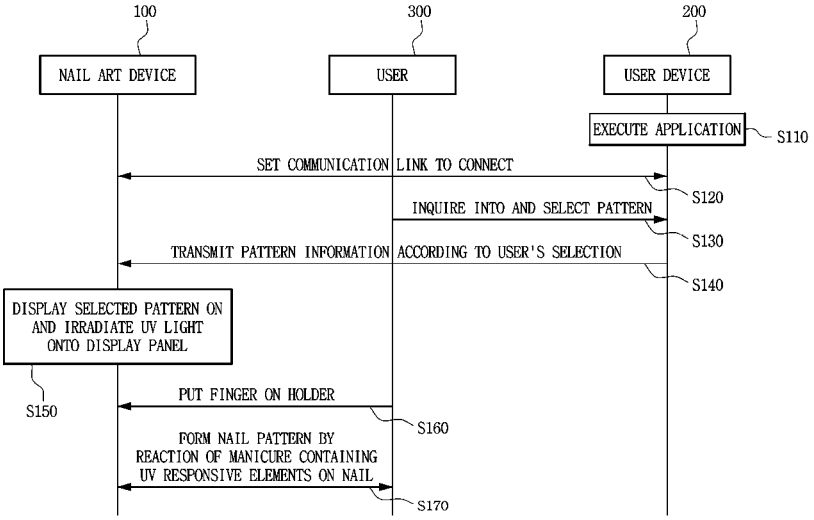
FIG. 4 is a flowchart of a nail art method according to a further embodiment.

FIG. 4 is a flowchart of a nail art method according to a further embodiment.

First, a user 300 executes an application for nail art work on user's own user device 200 (S110). Then, the user device 200 is mutually connected with a nail art device 100 by automatically or manually setting a communication link with the nail art device 100 (S120).

Subsequently, the user 300 inquiries into a plurality of patterns for nail art using the application of the user device 200, and then selects a desired specific pattern of them (S130) to transmit information of the pattern to the nail art device 100 (S140).

The nail art device 100, which receives the pattern information according to a user's selection from the user device 200 through step S140, displays a pattern selected by the user on a provided display panel 120 in response to the received pattern information (S150). In addition, the nail art device 100 drives a UV irradiation unit 130 to irradiate UV light onto the display panel 120 (S150).

In this case, the user puts a finger, a nail of which is applied with a manicure containing UV responsive elements, on a holder 110 of the nail art device 100, and causes the nail, on which nail art work is to be performed, to be located at a position facing the display panel 120 (S160).

When the finger, the nail of which is applied with the manicure containing UV responsive elements, is put on the holder 110 of the nail art device 100, the finger put on the holder 110 is located beneath the display panel 120 which is displaying the selected pattern. Consequently, a nail pattern is formed while the manicure containing UV responsive elements on the nail reacts to UV light transferred by transmitting the display panel 120 so as to be cured to have a shade difference due to transmittance of the UV light (S170).

The configuration of nail art device, system and method using a UV is not limited the above-described embodiments, and can be carried out by various modifications within the spirit and scope of the invention.

INDUSTRIAL APPLICABILITY

A nail art device, system and method, which can engrave an elaborate and beautiful pattern on a nail by improving a limit of a printing manner, may be provided. Further, a nail art device, system and method, which can maximally realize characteristics, such as texture, color, and expression, of nail art using a manicure, may be provided.

The invention claimed is:

1. A nail device comprising:

a control unit;

a holder;

a display panel to display a predetermined selected pattern under control of the control unit and;

a UV irradiation unit to irradiate UV light onto the display panel, wherein a manicure containing UV responsive elements on a nail, which is put on the holder, reacts to UV light transferred by transmitting the display panel to thus form a nail pattern;

a communication unit which communicates with an external user device, wherein the control unit receives pattern information according to a user's selection through the communication unit from the user device, and then outputs a control signal corresponding to the received pattern information, thereby allowing the selected pattern to be displayed on the display panel.

2. The nail art device according to claim 1, wherein the holder is concavely formed at a position facing the display panel such that a finger, the nail of which is applied with the manicure containing UV responsive elements, is put on the holder.

3. The nail art device according to claim 1, wherein the nail pattern is formed by giving a shade difference to the manicure containing UV responsive elements applied to the nail using the difference of UV transmittance due to the selected pattern formed on the display panel.

4. The nail art device according to claim 1, wherein the display panel is a liquid crystal display panel.

* * * * *